United States Patent [19]

Petit et al.

[11] Patent Number: 4,487,466

[45] Date of Patent: Dec. 11, 1984

[54] SERIES/PARALLEL ELECTRICAL CONNECTOR, PARTICULARLY FOR USE WITH CHASSIS-MOUNTED PRINTED CIRCUIT CARDS

[75] Inventors: André Petit, Longpont sur Orge; Daniel Jamet, Nozay, both of France

[73] Assignee: Compagnie Industrielle des Telecommunications Cit-Alcatel, Paris, France

[21] Appl. No.: 449,343

[22] Filed: Dec. 13, 1982

[30] Foreign Application Priority Data

Dec. 11, 1981 [FR] France ..... 81 23181

[51] Int. Cl.[3] ..... H01R 29/00; H01R 27/02

[52] U.S. Cl. ..... 339/32 M; 339/33

[58] Field of Search ..... 339/32, 33

[56] References Cited

U.S. PATENT DOCUMENTS

| | | | |
|---|---|---|---|
| 2,747,177 | 5/1956 | Keller | 340/276 |
| 3,129,991 | 4/1964 | Schmitz | 339/32 R |
| 3,903,385 | 9/1975 | Sae | 339/176 |

FOREIGN PATENT DOCUMENTS

| | | |
|---|---|---|
| 1665071 | 1/1977 | Fed. Rep. of Germany . |
| 2185914 | 1/1974 | France . |
| 2319219 | 2/1977 | France . |
| 2383534 | 10/1977 | France . |
| 2407583 | 5/1979 | France . |

*Primary Examiner*—Joseph H. McGlynn
*Assistant Examiner*—Paula Austin
*Attorney, Agent, or Firm*—Sughrue, Mion, Zinn, Macpeak, and Seas

[57] ABSTRACT

A connector comprises a socket and a plug. The socket is located on the edge of a printed circuit card and comprises two contact tabs at different distances from the edge. A housing is placed near the tabs to receive the plug and to hold two electrically interconnected spring contact blades in contact with the tabs. If the plug is inserted one way up into the socket, its blades are connected to respective ones of the tabs, therby establishing a connection. Alternatively, if the plug is inserted the other way up, the tabs of the socket are interconnected by the first spring contact blade of the plug, thereby establishing parallel connection.

17 Claims, 11 Drawing Figures

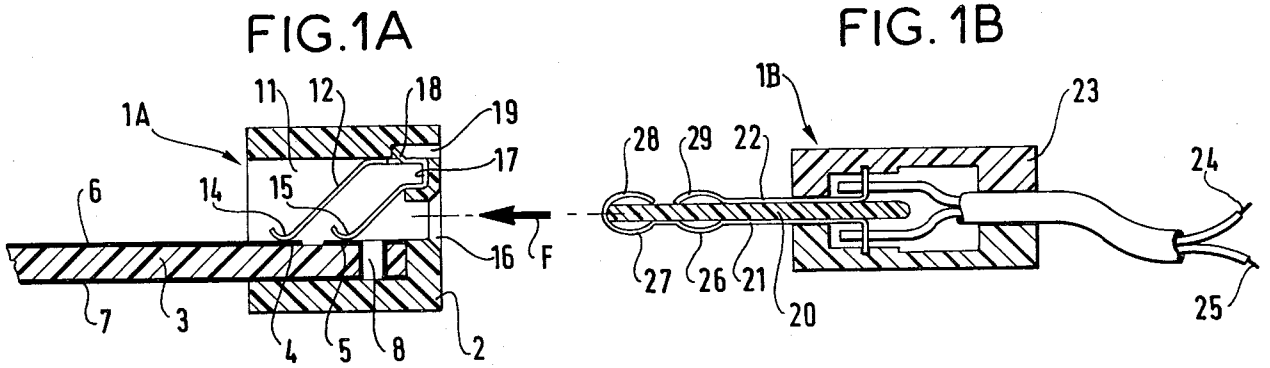
FIG. 1B
FIG. 1A
1A
1B
2
3
4
5
6
7
8
11
12
14
15
16
17
18
19
20
21
22
23
24
25
26
27
28
29
F
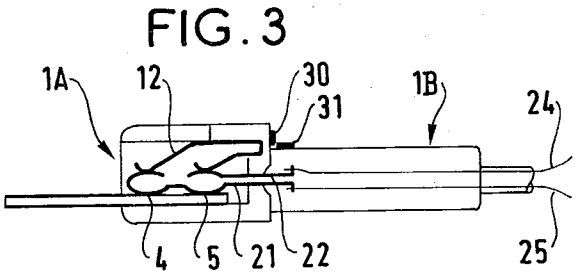
FIG. 3
1A
1B
4
5
12
21
22
24
25
30
31
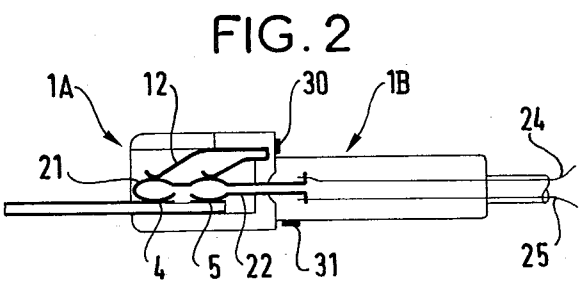
FIG. 2
1A
1B
4
5
12
21
22
24
25
30
31

SERIES/PARALLEL ELECTRICAL CONNECTOR, PARTICULARLY FOR USE WITH CHASSIS-MOUNTED PRINTED CIRCUIT CARDS

The present invention relates to electrical connectors, and is particularly for use in performing measurements and tests on circuits for electronic telecommunications equipment.

BACKGROUND OF THE INVENTION

It is well known that, during normal operation of such equipment, it is necessary to perform measurements concerning the currents and the voltages at various points of individual printed circuit cards on which the various electronic components making up the electronic equipment are mounted.

It is normal practice to use a connector which is specific to the kind of connection required, ie. one kind of connector is used for a parallel or voltage-measuring connection, while another type of connector is used for a series or current-measuring connection.

Preferred embodiments of the present invention provide an electrical connector capable of providing a series connection or a parallel connection depending on a user's choice and without requiring any modification to the connector. Such a connector is thus easy to use to measure current or voltage.

SUMMARY OF THE INVENTION

In a first aspect the present invention provides a series/parallel connector comprising a socket having a pair of contact terminals and a plug suitable for insertion into said socket;

wherein the socket comprises: a portion of a printed circuit card having a pair of contact tabs disposed on the same face of the card, close to a first edge of the card, at different distances therefrom, and at a predetermined spacing from each other; an insulating housing mounted on said first edge of the card over said pair of contact tabs; and a pair of electrically interconnected spring blades mounted by said housing to make resilient contact with respective ones of said tabs; said housing further including an opening for receiving said plug; and wherein said plug comprises an insulating support bearing first and second spring contact blades, said first spring contact blade providing first and second contact points on a first side of said insulating support together with a third contact point on a second side of said insulating support opposite to said first side thereof, and said second spring contact blade providing a single fourth contact point on said second side of said insulating support, said contact points on each side of said support being at said predetermined spacing;

the relative disposition of said plug and said socket being such that when said plug is received in said socket, the contact points on one side of the plug make contact with respective ones of the tabs while the contact points on the other side of the plug make contact with respective ones of the spring blades of the socket, whereby inserting the plug one way up in said opening causes the spring contact blades of the plug to be electrically interconnected by the electrically interconnected spring blades of the socket, while the contact tabs of the socket are electrically interconnected by the first spring contact blade of the plug, thereby establishing a parallel connection between the plug and the contact tabs; and whereby rotating the plug through 180° and inserting it the other way up in said opening, causes a first one of the contact tabs to be connected to the first spring contact blade of the plug whose other two contact points are in contact with the already electrically interconnected spring blades of the socket, while the other contact tab is connected to the second spring contact blade of the plug, thereby establishing a series connection between the plug blades and the contact tabs.

Further aspects of the present invention make use of the above-defined first aspect, firstly to provide a multiple test point connector providing series/parallel connections to test points made available at the front edge of a printed circuit card, ie. the edge which remains available when the card is inserted in a chassis, and secondly to provide a multiple test point connector-extender providing series/parallel access to any of the connections to a circuit card while in operation.

Thus in a second aspect the present invention provides a multiple test point series/parallel connector for a chassis-mounted printed circuit card, said connector including a plurality of series/parallel connectors according to claim 1, said multiple test point connector comprising a multiple test point socket and a mating multiple test point plug, wherein:

said multiple test point socket is located on the front edge of a printed circuit card, ie. on the edge which remains accessible when the card is mounted in a chassis, and comprises an insulating housing, a group of pairs of contact tabs located near the front edge of the circuit card, and respective pairs of electrically interconnected spring blades interconnecting said pairs of tabs, said housing having a plug-receiving opening giving access to the group of pairs of tabs; and said multiple test point plug comprising an insulating support suitable for insertion into said opening, and a group of first and second spring contact blades disposed to provide a series or a parallel connection to respective ones of the pairs of contact tabs depending on the orientation of the plug when inserted into the socket.

Preferably the connector comprises a plurality of multiple test point sockets mounted in a single insulating housing having a plurality of plug-receiving openings. A plurality of multiple test point plugs for simultaneous connection to said plurality of sockets, may then also be provided, and advantageously the spring contact blades on each multiple test point plug are all mounted with the same orientation, whereby all the connections made by any one plug on any one insertion are of the same type, ie. all series or all parallel.

In a third aspect the present invention provides a series/parallel connector-extender for use in testing chassis-mounted printed circuit cards, the connector-extender comprising a first portion for insertion into a chassis in the place of a card to be tested and including printed circuit card connectors suitable for making contact with card-receiving connectors in the chassis, and a second portion which is located outside the chassis when the first portion is received therein and which is provided with card-receiving connectors matching those of the chassis and electrically connected to said printed circuit connectors of the first portion in such a manner as to make appropriate connections to a card which is received in the card-receiving connectors when the first portion is received in the chassis; wherein said second portion is also provided with at least one bank of series/parallel connector sockets according to claim 1 providing access to the individual electric circuits of said card-receiving connectors whereby test connections may be made thereto in series or in parallel by series/parallel connector plugs according to claim 1.

Preferably the connector-extender comprises a row of series/parallel sockets along either side of each card-receiving connector, with the series/parallel sockets running along either side of the same card-receiving connector being disposed on a single printed circuit card common to all the sockets on both sides of the card-receiving connector.

BRIEF DESCRIPTION OF THE DRAWINGS

Embodiments of the invention are described by way of example with reference to the accompanying drawings, in which:

FIGS. 1A and 1B are cross sections through a series/-parallel socket and its mating plug respectively;

FIGS. 2 and 3 are schematic diagrams respectively showing how a series connection and a parallel connection are obtained;

MORE DETAILED DESCRIPTION

Figure 4:
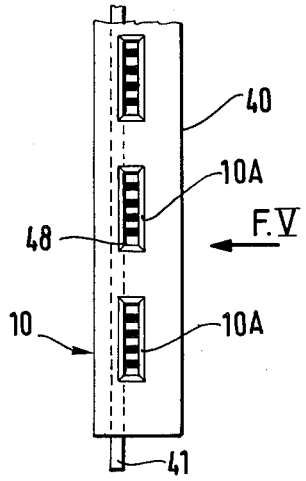
FIG. 4 is a front view of a connection strip comprising a plurality of multiple test point sockets as shown in FIG. 1A.

FIGS. 1A and 1B show one embodiment of a series/-parallel connector in accordance with the invention. It comprises a socket 1A and a plug 1B suitable for insertion into the socket.

The socket 1A comprises a housing 2 made of insulating material and mounted on an edge of a printed circuit card 3 which includes a pair of contact tabs 4 and 5 which are to be connected either in series or in parallel to some other circuit by means of the plug 1B.

The two contact tabs 4 and 5 are on the same face of the printed circuit card inside the housing 2. They are at a predetermined spacing from each other and at different distances from the edge of the card.

The tabs 4 and 5 are formed at the ends of respective conductor tracks 6 and 7 which are printed on opposite sides of the printed circuit card. Thus the track 6 is one the same side of the card as the tabs 4 and 5, while the track 7 is on the other side, and is connected to the tab 5 via a plated hole 8.

The tracks 6 and 7 lead to a portion of an electronic circuit mounted elsewhere on the card and not shown in these figures, whereby the tabs 4 and 5 constitute test points for said circuit.

The housing 2 has a hollow space 11 therein housing an inclined U-shaped conductive member 12. The legs of the U-shaped member comprise spring blades having curved contact tips 14 and 15 making resilient contact with respective ones of the contact tabs 4 and 5. When the socket is not receiving a plug, the spring blades serve to electrically interconnect the tabs 4 and 5.

The housing 2 further includes an opening 16 for receiving a plug 1B into the socket 1A. The opening 16 is made in the front of the housing, ie. the opposite face to the face which receives the printed circuit card, and it is so located that a plug 1B inserted through the opening in the direction of an arrow F enters into the space 11 inside the housing in between the tabs 4 and 5 and the resiliently biased tips 14 and 15 of the U-shaped member 12, thereby breaking the contact between the tabs as established via the tips.

The U-shaped member 12 is held in the housing 2 by means of a shoulder portion 17 which is embedded in a matching recess in the front wall of the housing, just above the opening the opening 16 (where "above" relates only to the orientation shown in FIG. 1A). The member 12 is retained in its recess by means of a latch 18 cut out from the base of the U-shape and lodged in a holding notch 19 formed in the upper wall of the housing. The resilience of the U-shaped member enables it to be initially pushed into place from the rear face of the housing.

The housing 2 is generally made of moulded plastic insulating material, and the surface of the resilient member 12 is advantageously coated with a lead-tin alloy to protect it against corrosion and to ensure good contact with the tabs 4 and 5 on the printed circit card.

The plug 1B shown in FIG. 1B comprises an insulating support 20 on which first and second spring contact blades 21 and 22 are mounted, together with a base member 23 mounted on one side of the support 20 and serving both as a handle for the plug and to house electrical connections between each of the spring contact blades and respective electrical leads.

The first spring contact blade 21 extends over the length of one face of the support 20 and is folded over the end to come part of the way back along the other face, while the second spring contact blade 22 extends only part of the way along said other face, in line with the first blade, but not touching it. The spring contact blades form two pairs of contact points 26–27 and 28–29, one pair on each side of the support 20. The contact points comprises resilient projecting loops at said predetermined spacing of the contact tabs 4 and 5 in the socket, and they are suitably placed on the support to establish contact therewith when the plug is inserted in the socket. Thus, on one face of the support both contact points 26 and 27 are part of the first spring blade 21 and are therefore permanently connected to each other electrically. On the other side of the support 20, one of the contact points 28 is part of the first spring blade 21, while the other contact point 29 is part of the other spring blade 22. The contact point 28 is therefore in electrical contact with the contact points on said one side of the support, while the contact point 29 is isolated therefrom.

The other ends of the spring contact blades 21 and 22 extend along the support 20 into the base 23 where they are connected to respective conductor leads 24 and 25, which in turn are for connection to measurement or test apparatus suitable for testing the electronic circits to which the socket 1A is connected.

FIGS. 2 and 3 are diagrams showing the two possible forms of coupling (series or parallel) obtainable using the plug and socket described with reference to FIGS. 1A and 1B.

In FIG. 2, the plug 1B is at 180° to its position shown in FIG. 1B. In this position, the plug disconnects the contact tabs 4 and 5 from each other by lifting off the resilient legs of the U-shaped member 12. The tabs 4 and 5 are connected to respective ones of the spring contact blades 21 and 22 via respective contact points. It is thus possible to insert a current measuring instrument in series between the tabs 4 and 5 via the leads 24 and 25.

In FIG. 3, the plug is in the same position as shown in FIG. 1B. In this position the first spring contact blade 21 of the plug connects the tabs 4 and 5 to each other, and it can be seen that the lifted off resilient legs of the U-shaped member 12 are connected to to respective ones of the spring contact blades 21 and 22, thereby connecting said blades together. It is thus possible to perform a voltage measurement using either of the conductor leads 24 and 25.

It can thus be seen from FIGS. 2 and 3 that a series connection or a parallel connection can be set up at will depending on which way up the plug 1B is inserted into the socket. To make manipulation easier, it is advisable to provide reference marks 30 and 31 on the socket and on the plug respectively such that when the marks are far apart the user is reminded that the tabs 4 and 5 are disconnected by insertion of the plug, and that when the marks are close together the user is reminded of the tabs remaining in contact.

Figure 5:
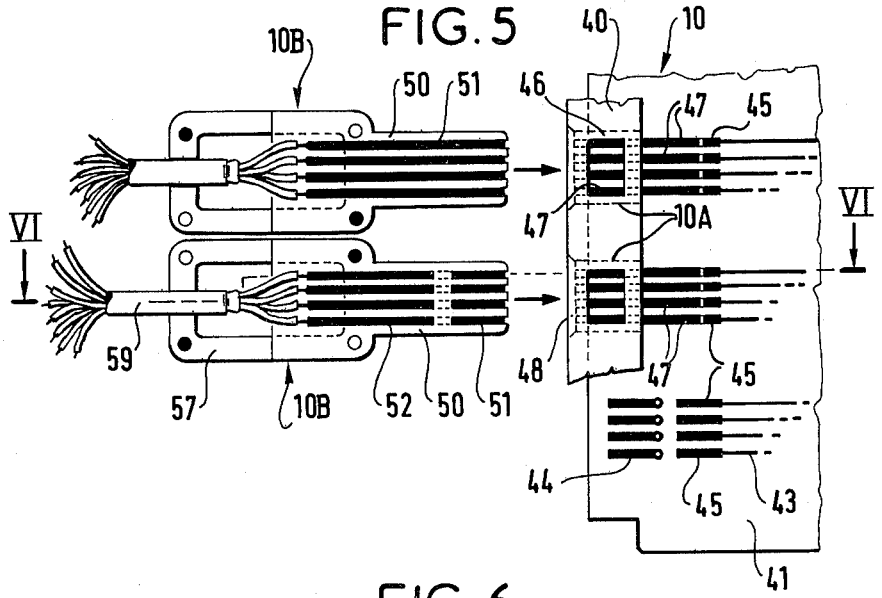
FIG. 5 is a partially cut away side view of the connection strip shown in FIG. 4, together with associated multiple test point plugs.
Figure 6:
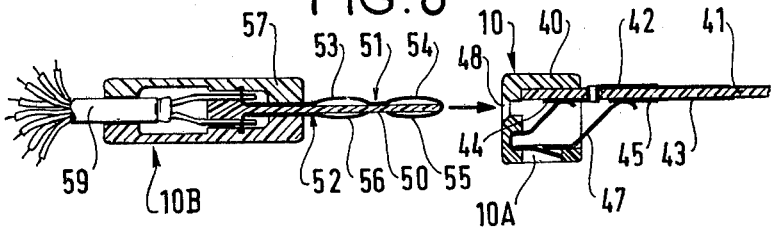
FIG. 6 is a plan view in section along a line VI—VI of FIG. 5.

FIGS. 4, 5 and 6 show a first application of the series/parallel plug and socket 1A and 1B described above. In this application there is a multiple test point connector strip 10 for performing test measurements on an electronic circuit on a printed circuit card. The strip is disposed along the front edge of the card, ie. the edge which remains accessible when the card is inserted in a chassis, and it co-operates with one or more multiple test point plugs 10B.

Unlike the single test point socket 1A, the strip 10 includes a plurality of sockets 10A, each of which gives access to a plurality of test points (four test points as shown). The various contact tabs for each test point are all mounted on the same printed circuit card.

The strip 10 comprises a single elongate insulating housing 40 mounted over the front edge of a printed circuit card 41, along which edge there are several groups of pairs of contact tabs 44–45. As before, the tabs comprise end portions of conductor tracks 42, 43 which are printed on both faces of the card 41 and which lead to various different points that need testing. The contact tabs are grouped in such a way that all the circuits tested by a single group need the same kind of test connection at the same time, ie. when a plug is inserted, the test points are connected to respective plug circuits all in series are else all in parallel.

The housing 40 has a plug-receiving space 46 disposed over each group of contact tabs, and inside each space there is a set of U-shaped members 47 for electrically interconnecting the contact tabs in pairs when there is no plug inserted in the socket. The U-shaped members 47 are substantially identical to those already described with reference to FIGS. 1A and 3, and they are held in place in the spaces 46 in the same manner.

The front face of the housing 40 presents a plug-receiving opening 48 leading to each plug-receiving space 46. The opening and the space are so arranged that when a mulitple test point plug 10B is inserted into the space via the opening, the plug lifts the resilient legs of the U-shaped members 47 off their respective contact pads 44 and 45 and becomes itself engaged between the resilient legs and the contact tabs.

The contact strip 10 thus comprises a plurality of test sockets 10A, each of which gives access to a corresponding group of contact tabs, with all the tabs being disposed on the same face of the same printed circuit card.

It will be observed that, unlike the housing 2 shown in FIGS. 1A to 2, the housing 40 shown in FIGS. 3 to 6 only covers one of the contact tabs of each pair. Thus the legs of the U-shaped members 47 are not totally lodged inside the housing 40, but project out from the back thereof in order to make contact with the contact tabs 45. Clearly the degree to which the housing actually covers the contact tabs and the associated U-shaped members is a design variable that can be modified to suit other constraints, the only point that matters is that the legs should make a good resilient contact with the tabs and that the plugs should also make good contact both with the tabs and with the legs.

The mulitple test point plugs 10B for engaging in the sockets 48 are identical to one another, and they are arranged to make the same kind of connection on all their contact points at the same time. The plug is removed and turned through 180° before being reinserted in order to change over from series conections to parallel connections or vice versa. While it would not be impossible to make a plug that made a mixture of types of connection each way up, such an arrangement appears to be more confusing than practical.

As can be seen in FIGS. 5 and 6, each multiple test point plug comprises a single insulating support 50 bearing a set of four pairs of spring contact blades 51–52. The first contact blade 51 of each pair extends over a first face of the support and comes back part way along the opposite or second face thereof. The second blade of each pair only extends part of the way along the second face towards the first blade, but not meeting it. The pairs of spring blades are provided with four deformations per pair to constitute four contact points 53 to 56, with three of the contact points 53 to 55 being on the first blade 51 and one of the contact points 56 being on the second blade 52. The contact points 53 to 56 are disposed so that when the plug is inserted in a socket 10A two of the contact points on one side of the support 50 make contact with a corresponding pair of contact tabs in the socket, while the other two contact points on the other side of the support 50 make contact with respective legs of the corresponding U-shaped member 47.

At the rear end of the support 50, the spring contact blades 51 and 52 are connected inside a base member 57 to respective leads of a cable 59.

It can readily be seen from FIG. 6 that inserting the multiple test point plug 10B into one of the sockets 10A of the strip 10 using the orientation shown in the figure, will give rise to four parallel connections to the corresponding contact tabs, in the manner shown in FIG. 3. Thus, inserting the plug 10B the other way round will clearly have the effect of establishing four series connections in the manner shown in FIG. 2.

Figure 7:
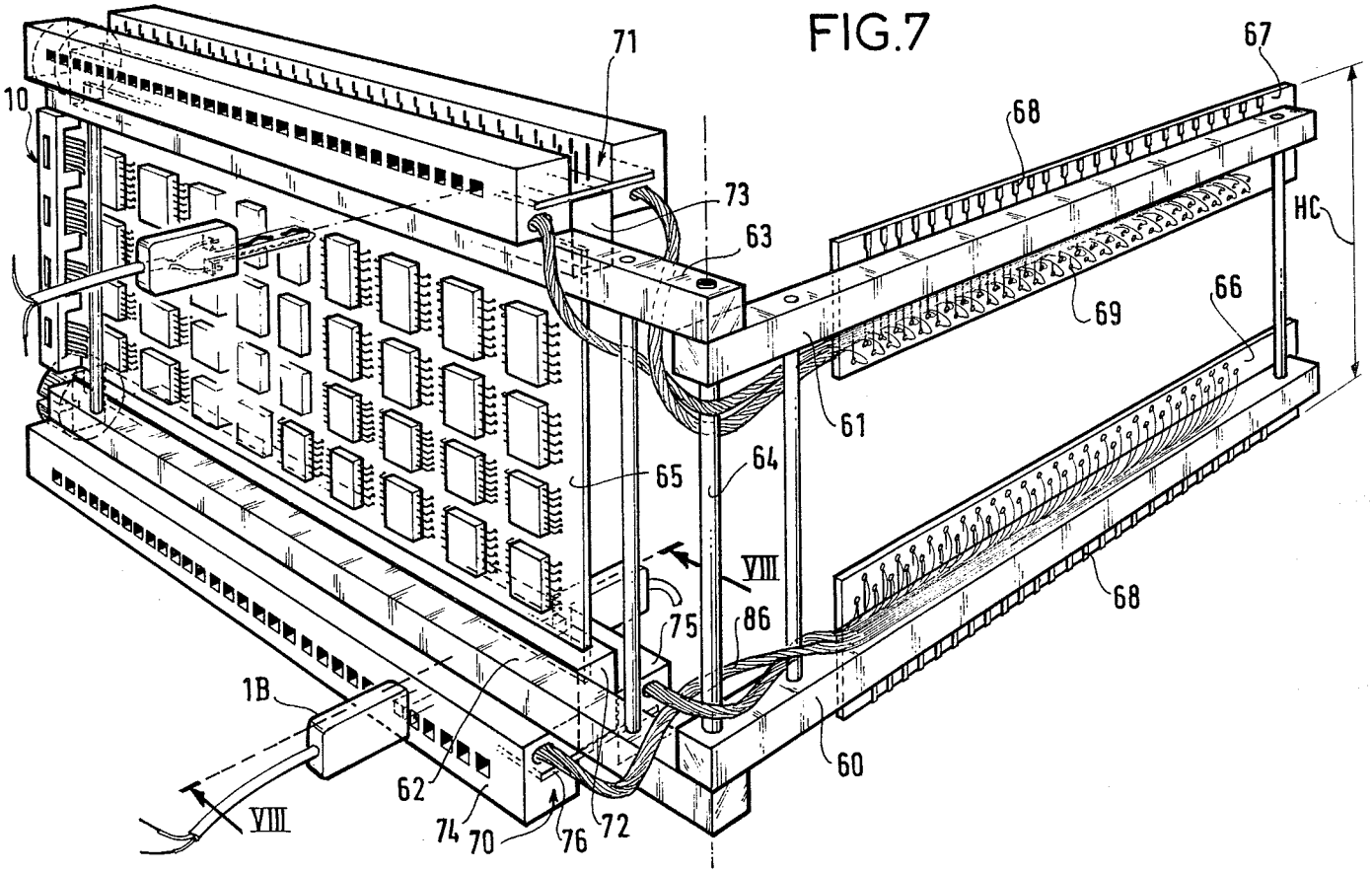
FIG. 7 is a perspective view of an connector-extender in which a printed circuit card is received for measurements and/or testing, said expander/connector being shown mated to a plug as shown in FIG. 1B.

FIG. 7 shows an application of the socket 1A in the construction of an extender-connector for performing test on a printed circuit card. The extender slots into the position in a chassis which normaly receives the card to be tested, and then the card to be tested is received in a portion of the extender which projects outside the chassis. Chassis connectors which are normally inaccessible during operation of the equipment are repeated outside the chassis, not only to receive the card under test, but also to have each connector lead connected to a corresponding individual series/parallel socket 1A, with the sockets 1A being arranged in rows along either side of the card-receiving connector. It thus becomes possible to have series or parallel access to any chosen connection to a printed circuit card, even during operation of the card and the rest of the equipment of which it forms a part.

The extender comprises a two portion structure: a first portion for insertion into a chassis comprises a pair of parallel beams 60 and 61 on which printed circuit edge connectors 66 and 67 are mounted for insertion into card-receiving connectors in the chasis in place of the card to be tested; and a second portion for receiving the card under test outside the chassis. The second portion comprises a second pair of parallel beams 62 and 63 on which card-receiving edge connectors 71 and 72 are mounted together with their associated rows of series/parallel sockets 1A. A card 65 is shown received by said second portion of the extender. The first and second portions are hinged to each other about a common post 64, and the distance between the pairs of beams is adjustable so that the same extender can be used with different widths of card.

The printed circuit edge connectors 66 and 67 are disposed in the same plane and their outer longitudinal edges are equipped with a series of edge connector tabs 68 printed on both faces of the connectors. Naturally the tabs 68 match the contacts in the card-receiving connectors of the equipment under test. The distance HC between the edges of the connectors 66 and 67 is adjusted to match the corresponding distance across the card under test. The tabs 68 are connected via respective printed circuit tracks to respective flexible leads (see connection 69), and thence to corresponding contacts in the card-receiving connector 73 on the second portion of the extender.

The beams 62 and 63 of the second portion carry identical equipment. Each has two rows 70 or 71 of sereis/parallel sockets 1A arranged on either side of a zero insertion force card-receiving connector 72 or 73. The contacts in the card-receiving connectors are connected in a one-to-one correspondance with the tabs 68 on the first portion, and hence to the corresponding contacts in the card-receiving connector into which the first portion is slotted in operation.

Figure 8:
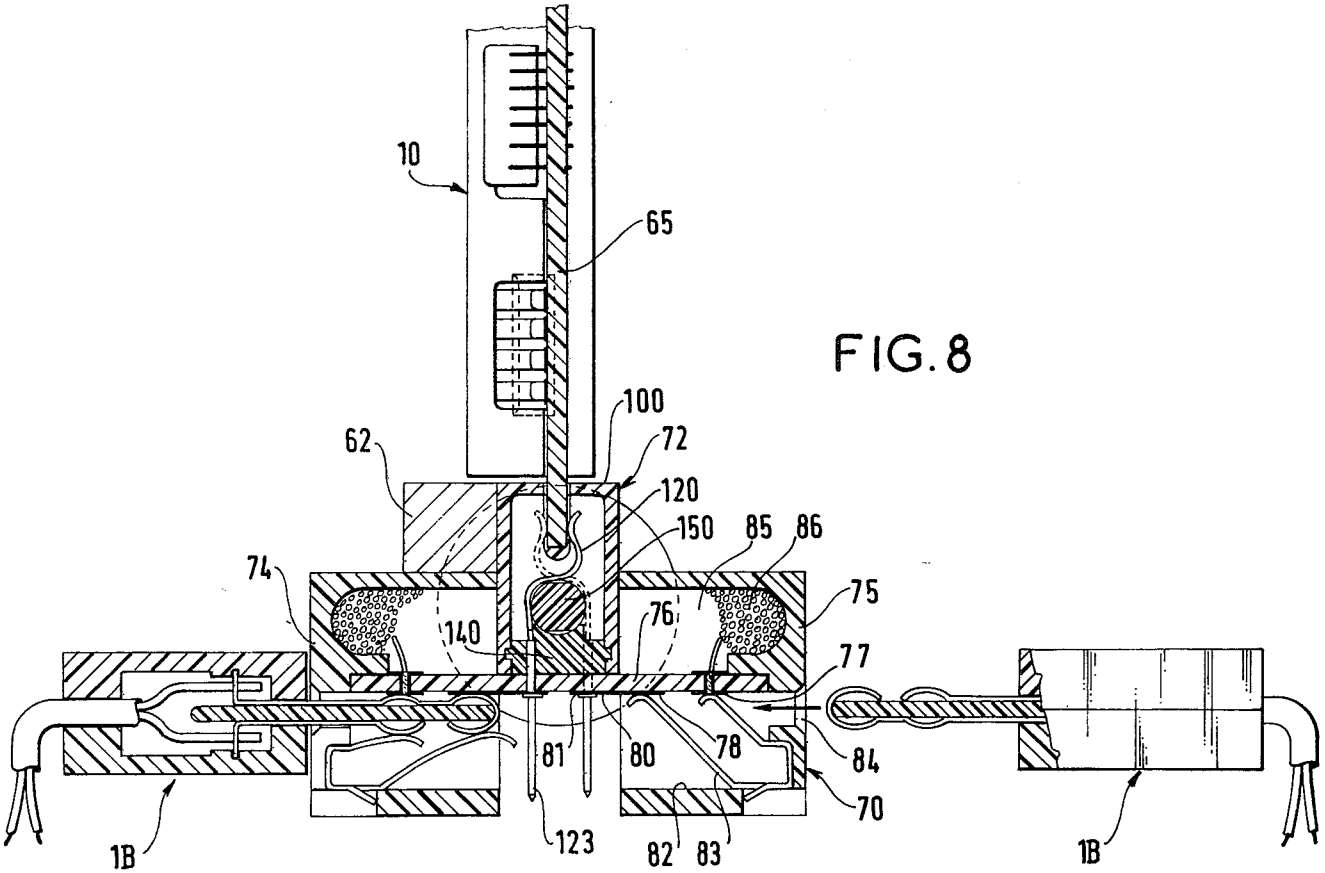
FIG. 8 is a section view along a line VIII—VIII of FIG. 7, showing one plug inserted in a socket and another plug about to be inserted.
Figure 9:
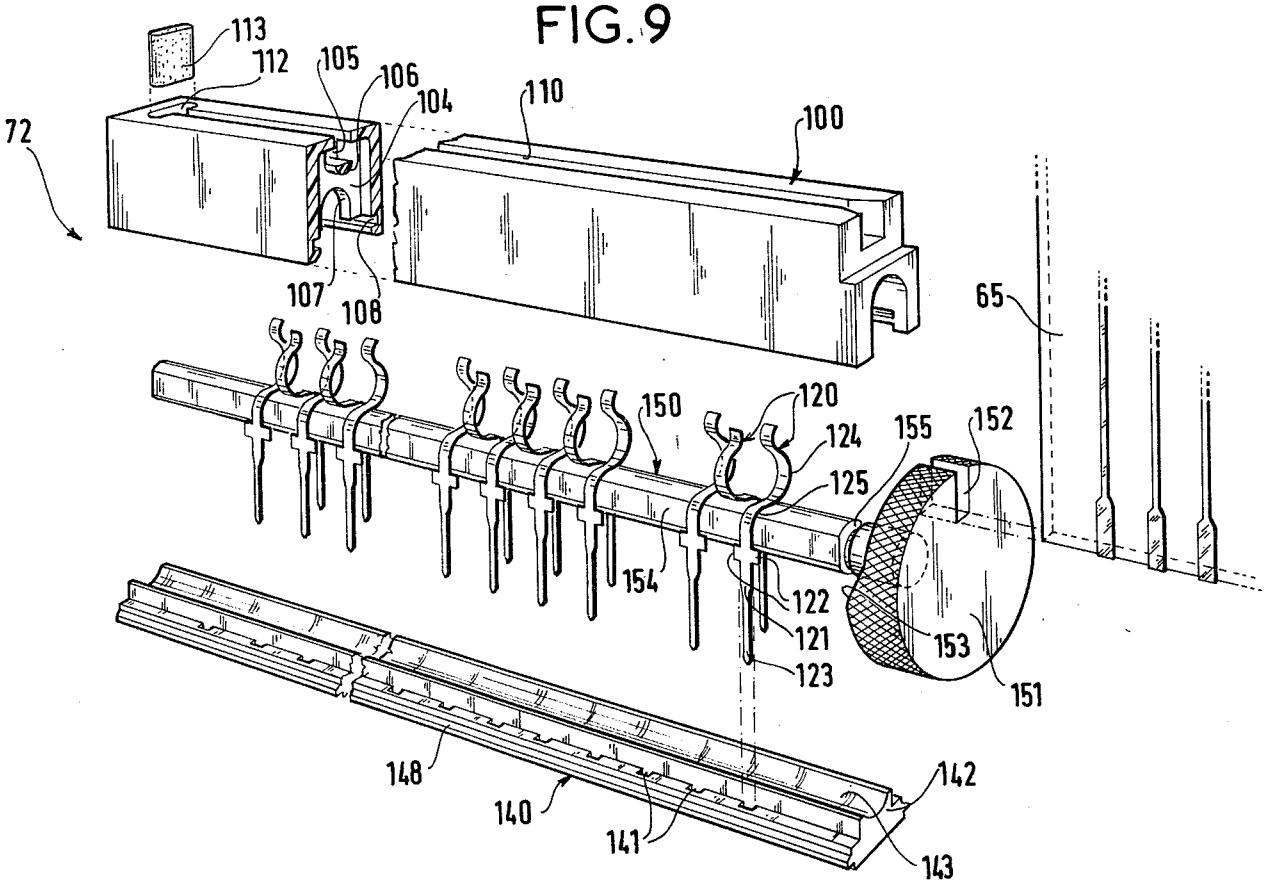
FIG. 9 is an exploded perspective view of one of the components of the connector-extender.

A more detailed description of the components of the second portion of the extender is given with particular reference to FIG. 8 which is a cross section through the beam 62 and the equipment mounted thereon, and to FIG. 9 which is an exploded perspective view of one of the zero insertion force connectors associated with the series/parallel sockets.

FIG. 8 shows two elongate housings 74 and 75 for the two rows 70 of series/parallel sockets 1A. The housings 74 and 75 are mounted along respective longitudinal edges of a printed circuit card 76. The card 76 has a row of pairs of contact tabs 77 and 78 along each edge. The tabs 77, closest to the edge, are constituted by metal plated holes connected to corresponding leads 86 for connection to the corresponding edge connector in the first portion of the extender. The tabs 78 are further from the edge and are connected by respective short lengths of printed circuit track to respective plated holes in a pair of parallel lines of plated holes receiving terminal posts 123 of the zero insertion force edge connector 72.

Each of the housings 74 and 75 defines two enclosed spaces: a first enclosed space 82, shown below the card 76 in FIG. 8, houses U-shaped members 83 for each series/parallel socket 1A in the same manner as already described with reference to FIGS. 1A to 3. The first enclosed space 82 may optionally be divided up into a series of compartments, say one compartment per socket 1A. Each socket 1A also has a plug-receiving opening 84 via which a plug 1B is inserted into the socket to make contact with its tabs 77 and 78 and with its U-shaped member 83.

The second enclosed space 85 of each of the housings 74 and 75 is shown above the printed circuit card 76 in FIG. 8. It constitutes a trough for lodging the flexible leads 86 which interconnect the chassis-mounted connectors to the extender-mounted connectors.

The zero insertion force connector 72 is shown in section in FIG. 8 and in an exploded view in FIG. 9. It is preferably of a type described in French patent application 81 11570.

Thus the zero insertion force connector 72 comprises a slideway 100, a set of contacts 120, a contact-bearing strip 140, and a rotatable shaft 150 for opening and closing the contacts 120.

The slideway 100 is mounted on the contact-bearing strip 140 and together they constitute a connector body having a partially empty interior volume in which the contacts 120 and the shaft 150 are mounted.

The slideway is a channel section member having a longitudinal slot 110 in its base web leaving two L-section portions which are held together by a regularly spaced series of partitions 104 delimiting chambers 105 in which the contacts 120 are housed. Facing the longitudinal slot, each partition 104 has a rectangular cut out which supports a strip 106 running the length of the slideway to constitute a floor to the slot 110 which receives the edge of a card to be tested 65.

The other side of the partions have cut outs 107 with rounded tops for engaging the shaft 150.

The bottom edges (as shown in FIG. 9) of the slideway are grooved on the inside to receive corresponding tongues 148 running along the sides of the contact-bearing strip 140 in a snap fit.

The slideway is a plastic moulding.

The slot 110 has a tapering guide portion at its leading end to guide an incoming card, and it has a cushion 113 inserted in a transverse slot 112 at its other end to stop a card when it has been pushed home.

The contacts 120 are mounted on the contact-bearing strip 140 from which they project into the chambers 105. The contacts are made from an initially flat strip of resilient conductor metal which is shaped to have a straight first end portion 121 topped by a cross piece in the form of two lugs 122 and ending in a terminal post 123. The other end portion 124 is shaped in a generally S-shaped curve and serves to make spring contact with the tabs on the edge of a card 65 received in the connector. An intermediate portion 125 is arcuate and co-operates with the shaft 150 to open or close the corresponding contact, thereby constituting a zero insertion force connector.

The contact-bearing strip 140 is generally in the shape of a squat upsidedown T with a short broad riser 142 in the middle between two rows of holes 141 at a regular spacing on either side thereof. The holes on one side are placed opposite the mid portion of the space between two adjacent holes on the other side. The outer edges of the cross piece of the T have the above-mentioned tongues 148 projecting outwardly therefrom to engage the grooves 108 in the slideway, and the top of the squat riser 142 is trough-shaped to receive the bottom surface of the shaft 150 whose top surface is held down by the curved portions 107 of the partitions 104.

The contact-bearing strip is advantageously made from the same kind of plastic moulding as the slideway.

The shaft 150 is also made of plastic. It is slightly longer than the slieway and the contact-bearing strip 140 and has a camming knob 151 at one end, which knob remains outside the slideway when the connector is assembled. Rotating the knob serves to open and close the contacts. There is a notch 152 in the knob 151 through which a card must pass to be slid into the slot 110. The shaft is therefore arranged so that when the notch 152 is aligned with the slot 110, the contacts are open. Further, the back of the knob 151 has a camming profile 153 serving to push a card fully home as the knob is rotated, thereby ensuring that it is correctly positionned longitudinally.

The shaft 150 is generally cylindrical, but it has a pair of diametrically opposite flats 154 running aong its length, at least where it passes between the contacts 120. The net result is that the shaft has a maximum and a minimum diameter over its operative length. Finally, the shaft has a circular groove 155 near to its knob 151, which groove is received in a semicircular portion of the slideway 100 (not shown) to ensure that the shaft cannot move axially once the connector is assembled.

The contacts 120 on the contact-bearing strip 140 have their intermediate arcuate portions 125 bearing against an arc of the shaft 150. In the position shown in FIG. 9, the contacts are open and the maximum diameter of the shaft is disposed vertically. It can be seen that the contacts can be closed by rotating the shaft through 90° to bring its maximum diameter to the horizontal. Clearly other arrangements could be devised in which the contrary is the case.

In greater detail, and with reference to FIGS. 8 and 9, it will be understood that a card 65 can be inserted into the connector 72 by rotating the shaft 150 by its knob 151 until the notch 152 lies in the axis of the slot 110. The card can then be slid into the connector through the notch 152. While the shaft remains in this position, the arcute intermediate portions 125 of the contacts rest in a substantially strain-free position against the flats 154 of the shaft causing their S-shaped terminal portions 124 to stay away from the mid plane through the slideway. Thus as the card 65 slides along the slot 110 its contact tabs do not come into contact with the S-shaped terminal portions 124. Once the card 65 is nearly home, the knob 151 is rotated until the notch 152 is at right angles to the slot 110. The rotation can only take place if the card has moved beyond the notch, but if it has not gone the whole way in, the camming back surface 153 of the knob 151 serves to push the card hime. Once rotated at right angles, the arcuate intermediate portions 125 of the contacts are pushed outwardly by the greater diameter of the shaft causing the corresponding S-shaped portions 124 to move inwards towards the mid plane of the connector. The contacts are thus closed and electrical connection is established between each contact 120 and a corresponding track on the printed circuit card 65.

In the extender assembly where the connector 72 lies between two rows of series/parallel sockets 1A, the connector 72 serves to connect each track on the edge of the card received thereby to a corresponding contact tab 78. The U-shaped members 83 then serve to extend the connection to the contact tabs 77, and hence to the conductors 86 leading to the first portion of the extender.

A parallel connection can thus be made to any of the leads connected to the connector 72 simply by inserting a plug 1B into the corresponding socket 1A. The appropriate orientation for the plug is shown in FIG. 3 and to the left hand side of FIG. 8. Similarly, a series connection can also be made in any of the leads connected to the connector 72, simply by inserting a plug 1B the other way up into the corresponding socket 1A. This orientation is shown in FIG. 2 and to the right of FIG. 8.

The arrangement of the top beam 63 of the extender, is naturally the same as that shown in FIGS. 8 and 9 relative to the bottom beam 62.

Thus the extender-connector shown in FIGS. 7 to 9 provides full access to any of the connections to a printed circuit card while said printed circuit card is operating in some larger equipment.

It can be seen in FIGS. 7 and 8 that the card 65 being tested in the extender is also provided along its front edge with a connection strip 10 as described with reference to FIGS. 4 to 6.

Figure 10:
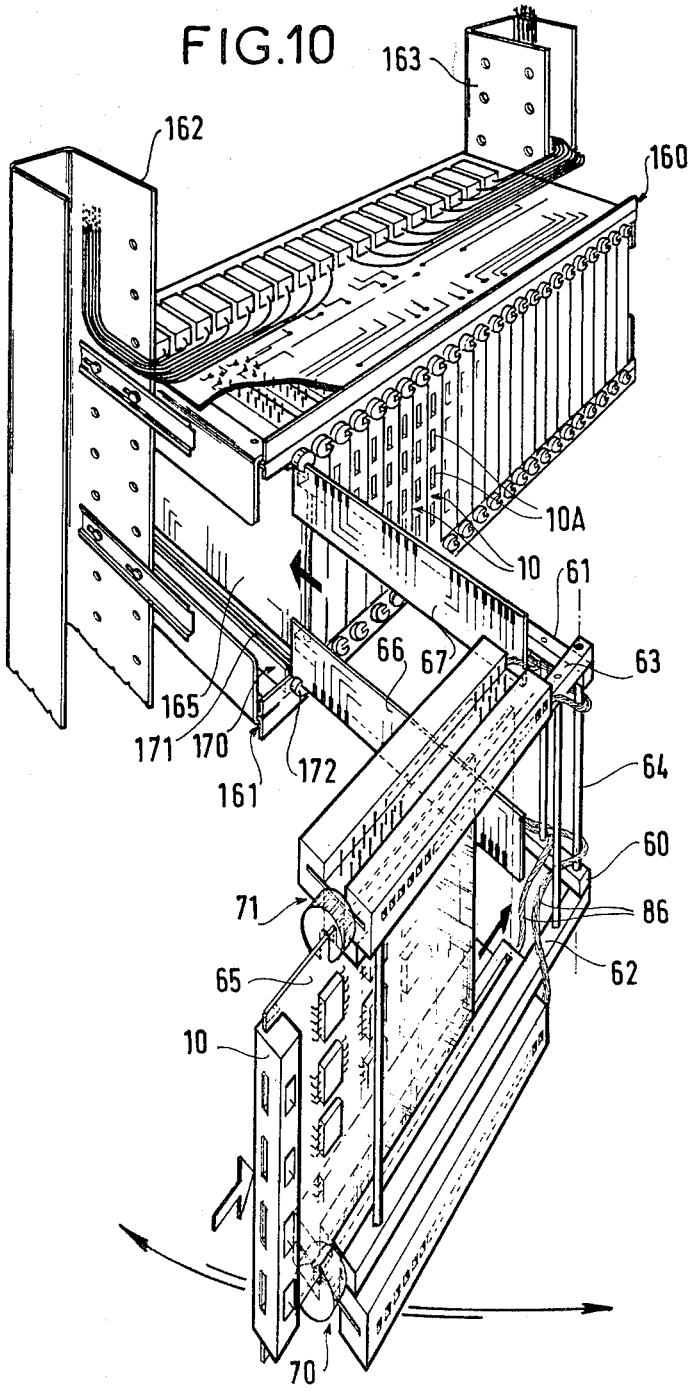
FIG. 10 is a perspective view of the connector-extender being inserted in a chassis in the place of a printed circuit card received in the connector-extender.

FIG. 10 shows both of the applications already described with reference to FIGS. 4 to 6 and with reference to FIGS. 7 to 9 in simultaneous use for testing a printed circuit card 65 of a chassis which is preferably of the kind described in French patent application 81 11569, filed 12th June 1981.

It can be seen in FIG. 10 that the chassis houses a plurality of vertically disposed circuit cards which are populated with electronic circuits and which are interconnected by edge connectors mounted in the chassis. The main structure of the chassis comprises a top plate 160, a bottom plate 161 and two risers 162 and 163 on which the plates are mounted at a suitable distance apart for receiving cards such as 165. Each plate 160 and 161 comprises a plurality of slideways such as 170 having card-receiving slots 171 disposed facing corresponding slots on the other plate. Each slideway has a zero insertion force connector lodged therein together with a camming control knob 172. It will be understood that the structure described with reference to FIGS. 8 and 9 is entirely suitable for this task.

All the cards received in the chassis shown in FIG. 10 have corresponding connection strips 10 disposed along their front edges, ie. their edges which remain accessible when they are received in the chassis. Each strip 10 has several multiple test point sockets 10A. The strips 10 serve both to provide test access to the cards by measn of appropriate plugs 10B, and also as handles for grasping when a card is being inserted or removed from the chassis.

An extender-connector is also shown being inserted into one of the card-receiving positions of the chassis. The card 65 to be tested is likewise shown being inserted into the extender. In practice, both insertion operations are not performed at once as shown, but the order of insertion need not be material. Various components of the extender are referenced with the same numerals in FIG. 10 as in FIGS. 7 to 9. In particular, its own zero insertion force connectors with their associated rows of series/parallel sockets 70 and 71 are shown, as are the flexible conductors 86, and the printed circuit edge connector cards 66 and 67 which take the place of the card 65 in the chassis and serve to bring out the normal connections required by the card 65 in operation.

It can further be seen that the extender is readily adaptible to chassis having different spacing between the top and bottom plates to accommodated different sizes of card. The only operation required is to change the spacing between the pairs of beams 60 and 61, and 62 and 63.

It can also be seen that if two adjacent cards in the chassis need to be brought out for testing at the same time, that the hinge arrangement about the post 64 enables access to be had to both of them at the same time, should that prove desireable.

Finally, since the extender remains in the chassis during use, its leads 86 are short, and the equipment can continue to operate at high frequencies that would be made impossible if the extender included an extension lead of any length.

We claim:

1. A series/parallel connector comprising a socket having a pair of contact terminals and a plug insertably received by said socket; the improvement wherein the socket comprises: a portion of a printed circuit card having a pair of contact tabs disposed on the same face of the card, close to a first edge of the card, at different distances therefrom, and at a predetermined spacing from each other; an insulating housing mounted on said first edge of the card over said pair of contact tabs; and a pair of electrically interconnected spring blades mounted by said housing and making resilient contact with respective ones of said tabs; said housing further including an opening for receiving said plug; and wherein said plug comprises a planar insulating support bearing first and second spring contact blades, said first spring contact blade providing first and second contact points on a first side of said insulating support together with a third contact point on a second side of said insulating support opposite to said first side thereof, and said second spring contact blade providing a single fourth contact point on said second side of said insulating support, said contact points on each side of said support being at said predetermined spacing;

the relative disposition of said plug and said socket being such that when said plug is received in said socket, the contact points on one side of the plug make contact with respective ones of the tabs while the contact points on the other side of the plug make contact with respective ones of the spring blades of the socket, whereby inserting the plug one way in said opening causes the spring contact blades of the plug to be electrically interconnected by the electrically interconnected spring blades of the socket, while the contact tabs of the socket are electrically interconnected by the first spring contact blade of the plug, thereby establishing a parallel connection between the plug and the contact tabs; and whereby rotating the plug through 180° and inserting it inverted in said opening, causes a first one of the contact tabs to be connected to the first spring contact blade of the plug whose other two contact points are in contact with the already electrically interconnected spring blades of the socket, while the other contact tab is connected to the second spring contact blade of the plug, thereby establishing a series connection between the plug blades and the contact tabs.

2. A connector according to claim 1, wherein said contact tabs are connected to respective conductive tracks on the printed circuit card, one of said tracks being connected through to the other side of the card at the connector.

3. A connector according to claim 1, wherein said plug further includes a base bearing conductor leads mounted on said support with the spring contact blades being connected to respective electrical conductor leads inside said base.

4. A multiple test point series/parallel connector assembly for a chassis-mounted printed circuit card, said connector assembly including a plurality of series/-parallel connectors comprising a socket having a pair of contact terminals and a plug insertably received by said socket, the improvement wherein the socket comprises:

a portion of a printed circuit card having a pair of contact tabs disposed on the same face of the card, close to a first edge of the card, at different distances therefrom, and at a predetermined spacing from each other;

an insulating housing mounted on said first edge of the card over said pair of contact tabs; and a pair of electrically interconnected spring blades mounted by said housing and making resilient contact with respective ones of said tabs;

said housing further including an opening for receiving said plug;

and wherein said plug comprises a planar insulating support bearing first and second spring contact blades, said first spring contact blade providing first and second contact points on a first side of said insulating support together with a third contact point on a second side of said insulating support opposite to said first side thereof, and said second spring contact blade providing a single fourth contact point on said second side of said insulating support, said contact points on each side of said support being at said predetermined spacing;

the relative disposition of said plug and said socket being such that when said plug is received in said socket, the contact points on one side of the plug make contact with respective ones of the tabs while the contact points on the other side of the plug make contact with respective ones of the spring blades of the socket, whereby inserting the plug one way in said opening causes the spring contact blades of the plug to be electrically interconnected by the electrically interconnected spring blades of the socket, while the contact tabs of the socket are electrically interconnected by the first spring contact blade of the plug, thereby establishing a parallel connection between the plug and the contact tabs; and whereby rotating the plug through 180° and inserting it inverted in said opening, causes a first one of the contact tabs to be connected to the first spring contact blade of the plug whose other two contact points are in contact with the already electrically interconnected spring blades of the socket, while the other contact tab is connected to the second spring contact blade of the plug, thereby establishing a series connection between the plug blades and the contact tabs;

said multiple test point connector comprising a multiple test point socket and a mating mulple test point plug, wherein:

said multiple test point socket is located on the front edge of a printed circuit card, remaining accessible when the card is mounted in a chassis, and comprises a common insulating housing, a group of pairs of contact tabs located near the front edge of the circuit card, and respective pairs of electrically interconnected spring blades interconnecting said pairs of tabs, said common housing having a plug-receiving opening giving access to the group of pairs of tabs; and said multiple test point plug comprising a common insulating support suitable for insertion into said opening, and a group of first and second spring contact blades disposed to provide a series or a parallel co-nection to respective ones of the pairs of contact tabs depending on the orientation of the plug when inserted into the socket.

5. A connector assembly according to claim 4, wherein each multiple test point plug further includes a base mounted on said common support with the spring contact blades being connected to respective electrical conductor leads inside said base.

6. A connector assembly according to claim 4, comprising a plurality of multiple test point sockets mounted in a single common insulating housing having a plurality of plug-receiving openings.

7. A connector assembly according to claim 6, comprising a plurality of multiple test point plugs for simultaneous connection to said plurality of sockets.

8. A connector assembly according to claim 7, wherein the spring contact blades on each multiple test point plug are all mounted with the same orientation, whereby all the connections made by any one plug on any one insertion are of the same type, ie. all series or all parallel.

9. A series/parallel connector-extender for use in testing chassis-mounted printed circuit cards, the connector-extender comprising a first portion for insertion into a chassis in the place of a card to be tested and including printed circuit card connectors suitable for making contact with card-receiving connectors in the chassis, and a second portion which is located outside the chassis when the first portion is received therein and which is provided with card-receiving connectors matching those of the chassis and electrically connected to said printed circuit connectors of the first portion in such a manner as to make appropriate connections to a card which is received in the card-receiving connectors when the first portion is received in the chassis; wherein said second portion is also provided with at least one bank of series/parallel connector sockets, each socket comprising a portion of a printed circuit card having a pair of contact tabs disposed on the same face of the card, close to a first edge of the card, at different distances therefrom and at a predetermined spacing from each other; an insulating housing mounted on said first edge of the card over said pair of contact tabs; and a pair of electrically interconnected spring blades mounted by said housing and making resilient contact with respective ones of said tabs; said housing further including an opening for receiving a plug; said at least one bank of series/parallel connector sockets providing access to the individual electric circuits of said card-receiving connectors whereby test connections may be made thereto in series or in parallel by series/parallel connector plugs and wherein each of said plugs comprises a planar insulating support bearing first and second spring contact blades, said first spring contact blades providing first and second contact points on a first side of said insulating support together with a third contact point on the second side of said insulating support opposite to said first side thereof, and said second spring contact blade providing a single fourth contact point on said second side of said insulating support, said contact points on each side of said support being at said predetermined spacing; the relative disposition of each plug and associated socket being such that when the plug is received in said socket, the contact points on one side of the plug make contact with respective ones of the tabs while the contact points on the other side of said plug make contact with respective ones of the spring blades of the socket; whereby inserting the plug one way in said opening causes the spring contact blades of the plug to be electrically interconnected by the electrically interconnected spring blades of the socket, while the contact tabs of the socket are electrically interconnected by the first spring contact blade of the plug, thereby establishing a parallel connection between the plug and the contact tabs; and whereby rotating the plug through 180° and inserting it inverted in said opening, causes a first one of the contact tabs to be connected to the first spring contact blade of the plug whose other two contact points are in contact with the already electrically interconnected spring blades of the socket, while the other contact tab is connected to the second spring contact blade of the plug, thereby establishing a series connection between the plug blades and the contact tabs.

10. A connector-extender according to claim 9, wherein said card-receiving connectors are zero insertion force connectors.

11. A connector-extender according to claim 10, wherein said zero insertion force card-receiving connectors are disposed facing each other to receive opposite edges of a printed circuit card.

12. A connector-extender according to claim 11, wherein the distance between between said facing card-receiving connectors is adjustable, and wherein the distance between the corresponding printed circuit card connectors on the first portion is likewise adjustable.

13. A connector-extender according to claim 10, wherein each of said zero insertion force connectors comprises a slideway having an elongate slot extending longitudinally along one side thereof for receiving the edge of a card to be tested, a plurality of contacts fixed to a contact bearing strip assembled to the side of the slideway opposite said one side and together with said slideway constituting a body of said zero insertion force connector, said contacts having first end portions projecting beyond the contact bearing strip outside the zero insertion force connector in the form of terminal posts arranged in two straight lines, second end portions which are S-shaped and which extending inwardly along either side of the card-receiving slot, and arcuate intermediate portions inbetween said first and second end portions co-operating with a longitudinally extending rotatable shaft mounted inside said slide way and having major and minor extreme diameters such that positioning the shaft so that the intermediate portions come into contact with one of its extreme diameters causes the S-shaped end portions to move away from a said slot, while positioning the shaft so that the intermediate portions come into contact with its opposite extreme diameter causes the C-shaped end portions to move towards said slot.

14. A connector-extender according to claim 13, wherein each terminal post is connected to one contact tab of a respective series/parallel connector socket, whose other contact tab is conected to a corresponding connector tab of the corresponding printed circuit card connector on the first portion of the connector-extender as a whole.

15. A connector-extender according to claim 9 comprising a row of series/parallel sockets along either side of each card-receiving connector.

16. A connector-extender according to claim 15, wherein the series/parallel sockets running along either side of the same card-receiving connector are disposed on a single printed circuit card common to all the sockets on both sides of the card-receiving connector.

17. A connector-extender according to claim 15, wherein each row of sockets includes a longitudinally extending trough for housing electrical conductors providing connections between said sockets and said printed circuit card connectors of the first portion of the connector-extender as a whole.

* * * * *